US009200455B2

(12) United States Patent
Preston

(10) Patent No.: US 9,200,455 B2
(45) Date of Patent: Dec. 1, 2015

(54) MOISTURE ISOLATING REVEAL SYSTEM

(71) Applicant: Innovations & Ideas, LLC, Tampa, FL (US)

(72) Inventor: Steven S. Preston, Tampa, FL (US)

(73) Assignee: Innovations & Ideas, LLC, Tampa, FL (US)

( * ) Notice: Subject to any disclaimer, the term of this patent is extended or adjusted under 35 U.S.C. 154(b) by 0 days.

(21) Appl. No.: 14/166,241

(22) Filed: Jan. 28, 2014

(65) Prior Publication Data

US 2015/0027074 A1 Jan. 29, 2015

Related U.S. Application Data

(60) Provisional application No. 61/858,555, filed on Jul. 25, 2013.

(51) Int. Cl.

| | |
|---|---|
| ***E04C 2/38*** | (2006.01) |
| ***E04F 13/06*** | (2006.01) |
| ***E04F 13/08*** | (2006.01) |
| ***E04F 19/06*** | (2006.01) |
| *E04D 13/04* | (2006.01) |

(52) U.S. Cl.

CPC ..... *E04F 13/06* (2013.01); *E04F 13/0803* (2013.01); *E04F 19/062* (2013.01); *E04D 13/0445* (2013.01); *E04D 13/0459* (2013.01); *E04D 13/0481* (2013.01)

(58) Field of Classification Search

CPC ..... E04D 13/0481; E04D 13/0445; E04D 13/0459

USPC ..... 52/302.1, 302.3, 302.7, 97, 408, 413, 52/459, 460, 461, 471, 716.2, 716.3, 52/716.5, 716.6, 716.7, 718.03, 717.05, 52/169.5, 209, 58, 61, 62, 281.7, 273, 472, 52/281, 282.1, 302.6

See application file for complete search history.

(56) References Cited

U.S. PATENT DOCUMENTS

| | | | | | |
|---|---|---|---|---|---|
| 4,622,791 | A | * | 11/1986 | Cook et al. | 52/241 |
| 4,660,339 | A | * | 4/1987 | Paz | 52/238.1 |
| 5,003,743 | A | * | 4/1991 | Bifano et al. | 52/288.1 |
| D324,575 | S | * | 3/1992 | Davis | D25/119 |
| 5,918,427 | A | * | 7/1999 | VanderWerf | 52/100 |
| 5,937,600 | A | * | 8/1999 | Larson | 52/302.6 |
| 6,293,064 | B1 | * | 9/2001 | Larson | 52/302.1 |
| 6,298,609 | B1 | * | 10/2001 | Bifano et al. | 52/58 |
| D554,773 | S | * | 11/2007 | Antonic | D25/119 |
| 8,336,273 | B2 | * | 12/2012 | Enns | 52/588.1 |
| 8,621,812 | B2 | * | 1/2014 | Holt | 52/509 |
| 2009/0183453 | A1 | * | 7/2009 | Koessler et al. | 52/302.3 |
| 2012/0255249 | A1 | | 10/2012 | Singh | |

* cited by examiner

*Primary Examiner* — Chi Q Nguyen

(74) *Attorney, Agent, or Firm* — Schwegman Lundberg & Woessner P.A.

(57) ABSTRACT

A moisture isolating reveal system includes a vertical trim piece having a fastening base configured for vertical coupling along a wall. A reveal flange extends from the fastening base. The fastening base and the reveal flange form a panel reception recess, and the panel reception recess is configured to receive a siding panel. A moisture isolation assembly extends along one or more of the reveal flange or the fastening base. The moisture isolation assembly includes: a nozzle ridge provided along the reveal flange, a moisture dam interposed between the nozzle ridge and the fastening base, the moisture dam prevents the ingress of moisture to the fastening base, and the nozzle ridge accelerates moisture moving between the nozzle ridge and an installed siding panel and decelerates moisture between the nozzle ridge and the moisture dam.

25 Claims, 8 Drawing Sheets

MOISTURE ISOLATING REVEAL SYSTEM

CLAIM OF PRIORITY

This patent application claims the benefit of priority to U.S. Provisional Patent Application Ser. No. 61/858,555, entitled "MOISTURE ISOLATING REVEAL SYSTEM," filed on Jul. 25, 2013, which is hereby incorporated by reference herein in its entirety.

TECHNICAL FIELD

This document pertains generally, but not by way of limitation, to reveal systems used with building walls.

BACKGROUND

Siding provides a decorative assembled façade to a building wall. In one example siding panels are nailed or fastened to an underlying wall with one or more screws, fasteners, nails or the like. The siding panels are optionally lapped over preceding siding panels for a corrugated appearance that directs moisture away from the building (e.g., liquids such as rain). Stated another way, the siding panels have a downward slope that directs moisture away from the building wall and a proceeding siding panel.

Some examples of reveal systems provide vertical and horizontal trim pieces that are installed along a wall. The trim pieces arrange and align the siding panels as they are installed and in a finished (fully installed) configuration. Additionally, the vertical and horizontal trim pieces optionally provide additional aesthetic appeal to the reveal system beyond that provided by the siding panels.

In some examples, the vertical trim pieces include a substantially planar nailing fin (e.g., a mounting wall) and a reveal flange. The nailing fin is coupled with the building wall, and the reveal flange extends from the nailing fin. Siding panels are retained between the reveal flange and the nailing fin. Gaps between the nailing fin and the reveal flange may allow moisture ingress (e.g., wind driven rain) around the vertical trim to the building wall.

In other example, the nailing fin includes a bump or projection that biases siding panels away from the nailing fin and toward the reveal flange. The bump creates a gap between siding panel and the nailing fin along the back of the siding panel. The gap accordingly directs moisture that has wrapped around the siding panel, and is near the building wall, along the gap created by the bump on the nailing fin.

OVERVIEW

The present inventor has recognized, among other things, that a problem to be solved can include reducing the ingress of moisture between a siding panel and an underlying wall surface. In an example, the present subject matter can provide a solution to this problem, such as by providing a moisture isolating reveal system having an isolation reservoir spaced from the underlying wall surface and a fastening base coupled with the wall surface. In one example, the system includes a vertical trim piece having a fastening base and a reveal flange extending from the fastening base. A moisture isolation assembly is provided along or more of the reveal flange and the fastening base. The moisture isolation assembly substantially prevents (e.g., minimizes, interrupts or the like) the ingress of moisture (e.g., liquids such as rain or wind driven rain) past the vertical trim piece and onto the overlying wall surface.

In one example, the moisture isolation assembly includes an isolation reservoir formed along the reveal flange. The isolation reservoir is optionally spaced from the fastener base. The isolation reservoir is configured to receive incidental moisture that passes a nozzle ridge of the reveal flange and contain the moisture within the reservoir to substantially prevent further ingress to the fastener base (and the underlying wall surface). In another example, the isolation reservoir is formed between the reveal flange and a siding panel received within a panel reception recess of the vertical trim piece. The reveal flange includes a nozzle ridge and a moisture dam that form the walls of the isolation reservoir. In one example, the nozzle ridge is provided along an end of the reveal flange, and the moisture dam is between the nozzle ridge and the fastener base. The moisture isolation assembly is effective with varying types of moisture including, but not limited to, rain, wind driven rain, pressure administered liquids (e.g., pressure washing fluids) or the like.

The present inventor has recognized, among other things, that a problem to be solved can include minimizing the kinetic energy of moisture to reduce the likelihood of the passage of moisture onto an underlying wall surface beneath a reveal system. In an example, the present subject matter can provide a solution to this problem, such as by providing a moisture isolating reveal system having one or more features that slow and capture moisture prior to reaching the underlying wall surface. The moisture isolating reveal system includes an isolation reservoir along a reveal flange. A nozzle ridge of the reveal flange includes an exterior face engaged with a siding panel. The exterior face of the nozzle ridge forms is tapered (e.g., forms a tapering acceleration gap with the siding panel) and accordingly accelerates moisture received along the exterior face. The opposed interior face of the nozzle ridge forms a reservoir gap wider than the acceleration gap. The wider reservoir gap slows the accelerated water and creates a deceleration region within the isolation reservoir that slows any moisture that incidentally moves past the nozzle ridge.

In another example, a moisture dam of the reveal flange is swept forward into the isolation reservoir from a dam base to a dam edge. Moisture in the isolation reservoir moving toward the moisture dam is redirected by the forward sweep of the moisture dam back in an opposed direction (e.g., back into the reservoir) away from the fastener base and the underlying wall surface. The moisture isolating reveal system is effective with varying types of moisture including, but not limited to, rain, wind driven rain, pressure administered liquids (e.g., pressure washing fluids) or the like.

This overview is intended to provide an overview of subject matter of the present patent application. It is not intended to provide an exclusive or exhaustive explanation of the invention. The detailed description is included to provide further information about the present patent application.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

Figure 1:
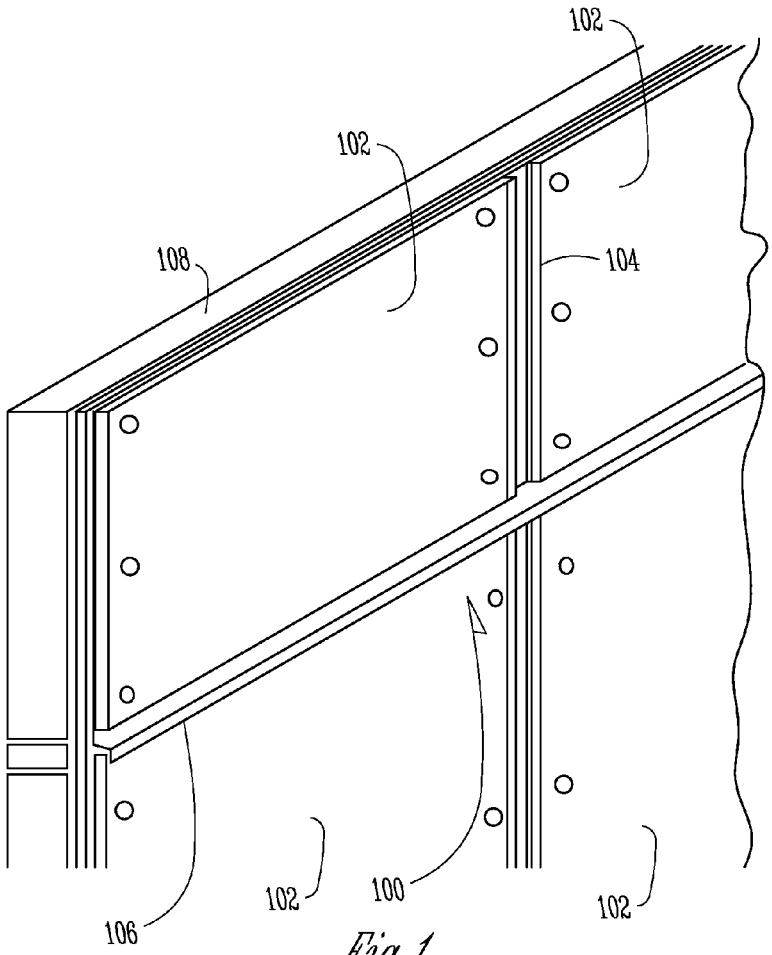
FIG. 1 is a perspective view of one example of a moisture isolating reveal system coupled over an underlying wall surface.

FIG. 1 shows a perspective view of one example of a moisture isolating reveal system 100. As shown, the moisture isolating reveal system 100 is installed along a wall 108. The moisture isolating reveal system 100 includes one or more vertical trim pieces 104 and horizontal trim pieces 106. The horizontal trim pieces 106 are coupled with the vertical trim pieces 104 as shown (e.g., in an intersecting or vertical and horizontal installation pattern). A plurality of siding panels 102 are installed along the wall 108 and coupled along corresponding portions of the horizontal trim pieces 106 and received within corresponding portions of the vertical trim pieces 104. As will be described herein the moisture isolating reveal system 100 provides a system configured to prevent (e.g., entirely prevent or mitigate, limit, throttle, constrain or the like) the ingress of moisture past (for instance) a reveal flange of the vertical trim pieces 104. The moisture isolating reveal system 100 thereby prevents ingress of moisture to the wall 108 (moisture including, but not limited to, rain, wind driven rain, pressure administered liquids such as pressure washing fluids, or the like). Accordingly, the vertical trim piece 104 of the moisture isolating reveal system 100 in one example directs water away from the wall 108 and instead maintains the water either along the siding panel 102 or, in the case of incidental moisture, along the reveal flange (described herein). Moisture moving over the siding panel 102 or delivered along the reveal flange of the vertical trim piece 104 is delivered to the horizontal trim piece 106 where the moisture is then delivered over the horizontal trim piece 106 to the underlying siding panel 102. As shown the horizontal trim piece 106 includes an overlying flange to ensure water does not move behind the siding panel 102 positioned beneath the horizontal trim piece 106.

Additionally, the moisture isolating reveal system 100 shown in FIG. 1 is also configured for installation with a rain screen system, and optionally forms a part of the rain screen system. For instance, the vertical and horizontal trim pieces 104, 106 space the siding panels 102 from the wall 108 to provide gaps (e.g., 0.25 to 0.5 inch spacing) for aeration and drainage of incidental moisture between the siding panels 102 and the wall 108. In another example, the moisture isolating reveal system 100 cooperates with a dedicated rain screen system. For instance, the rain screen system provides drainage and aeration openings and also spaces the siding panels 102 from the wall 108 (e.g., with one or more of furing strips, weep strips or the like). The moisture isolating reveal system in this example, is provided to prevent (e.g., entirely prevent or mitigate, limit, throttle, constrain or the like) the ingress of moisture as described herein.

Figure 2A:
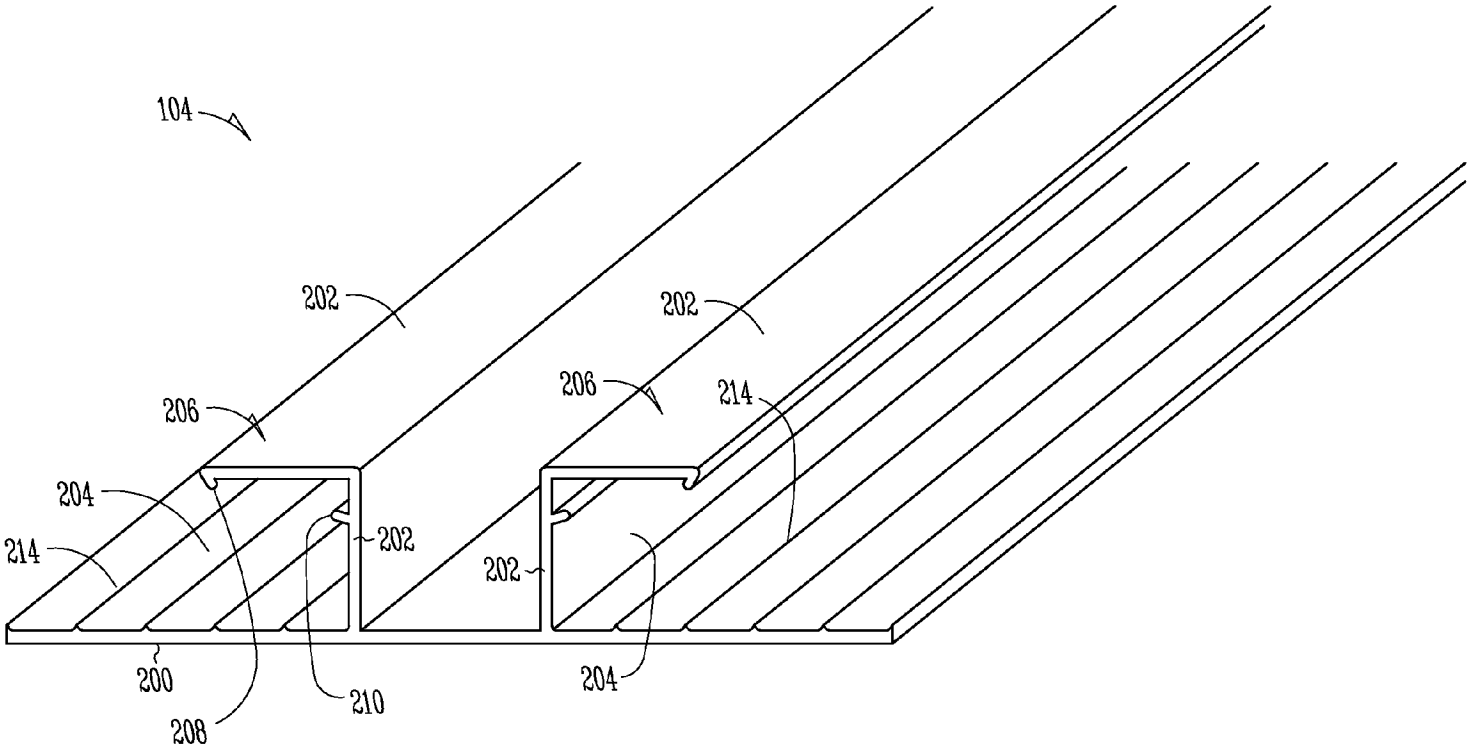
FIG. 2A is a perspective view of one example of a vertical trim piece. Briefly describe the components of the vertical trim piece.
Figure 2B:
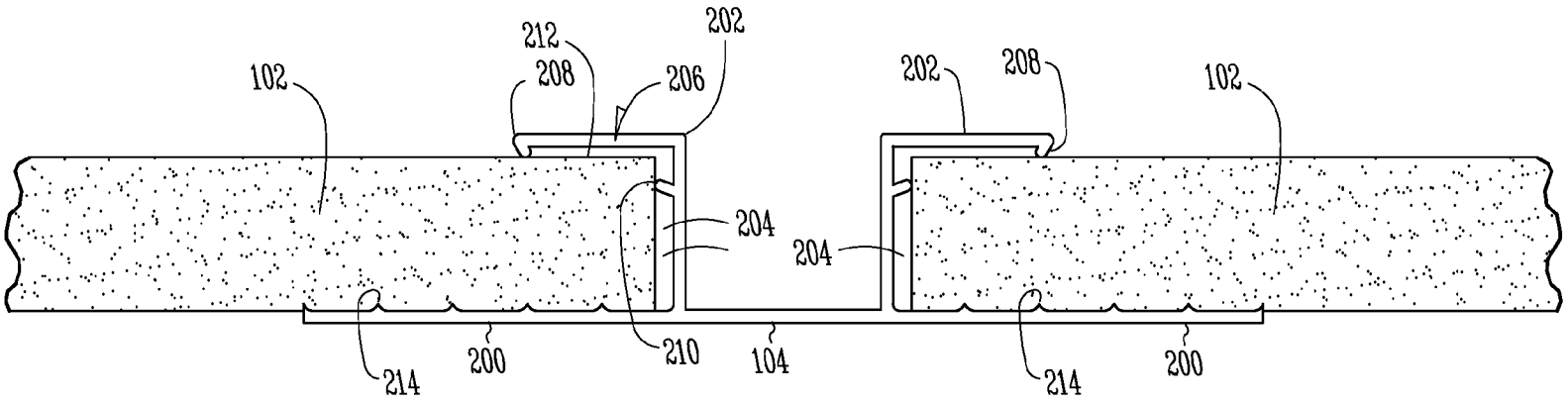
FIG. 2B is a cross sectional view of the vertical trim piece of FIG. 2A with a siding panel received within a panel reception recess.

Referring now to FIGS. 2A and 2B, one example of the vertical trim piece 104 previously shown in FIG. 1 is provided. Referring first to FIG. 2A, the vertical trim piece 104 is shown without a siding panel 102 received within a panel reception recess 204. As shown, the vertical trim piece 104 includes a fastening base 200 sized and shaped to lay along the wall 108 and thereby provide a coupling interface with the wall 108. In one example, the fastening base 200 is used in the manner of a nailing flange and is punctured (or includes holes) with fasteners to couple the vertical trim piece along the wall 108.

The vertical trim piece 104 further includes a reveal flange 202. In the example show in FIG. 2A, the vertical trim piece 104 includes reveal flanges 202 extend from the fastening base 200 to provide opposed panel reception recesses 204 for the reception of the edges of siding panels 102 therein. As shown in FIG. 1, each of the vertical trim pieces 104 is interposed between siding panels 102 and corresponding edges of the siding panels 102 are received within the panel reception recesses 204 shown in FIG. 2A. The siding panels 102 are received within the panel reception recess 204 between a portion of the reveal flange 202 and the fastening base 200.

Optionally, the fastening base 200 includes a corrugated seal surface 214 (e.g., one or more of scalloped ridges, saw tooth ridges or the like). The siding panel received within the panel reception recess 204 is in one example clamped between the reveal flange 202 by a nozzle ridge 208 (described herein below) and the corrugated seal surface 214. The clamping engagement between the nozzle ridge 208 and the corrugated seal surface 214 provides a tight engagement of the corrugated seal surface along the siding panel 102 and accordingly prevents (e.g., entirely prevents or mitigates, limits, throttles, constrains or the like) the ingress of moisture over the fastening base 200 for instance toward the wall 108 coupled along the fastening base 200. One example of the clamping engagement is shown in FIG. 2B. As shown, the siding panels 102 are each received in respective panel reception recesses 204. The nozzle ridge 208 and the corrugated seal surface 214 are engaged along opposed sides of the siding panels 102 to accordingly clamp the siding panels 102 therein. The corrugated seal surface 214 thereby engages in a sealing engagement with the siding panel 102 and accordingly prevents further ingress of moisture for instance past a moisture isolation assembly 206 (described herein) along the fastening base 200 and toward the wall 108.

As shown in FIGS. 2A and 2B the vertical trim piece 104 in one example includes separate reveal flanges 202 extending from the fastening base 200. As previously described the reveal flanges 202 cooperate with the fastening base 200 to provide panel reception recesses 204 for one or more siding panels 102. In the example shown in FIGS. 2A and 2B separate panel reception recesses 204 are included between separate reveal flanges 202 and the fastening base 200 to correspondingly retain two siding panels 102 therein. In another example, the reveal flange 202 is a unitary piece extending from the fastening base 200. For instance, the vertical trim piece 104 includes a single reveal flange 202 configured to receive a single siding panel 102 within a panel reception recess 204 formed by the reveal flange. In still another example, the vertical trim piece 104 includes dual reveal flanges 202 formed from a unitary piece of material. For instance the reveal flange 202 extends from the fastening base 200 and thereafter splits (in a "T" configuration) into separate flanges extending away from a single member perpendicular to the fastening base 200. Stated another way, the gap formed between each of the reveal flanges 202 for instance in FIGS. 2A and 2B is absent in such a configuration. Instead a single reveal flange 202 extends from the fastening base 200 and then splits into separate flanges that extend parallel to the fastening base 200 to correspondingly form the panel reception recesses 204 for the siding panels 102.

The vertical trim piece 104 includes a moisture isolation assembly 206 as shown in FIGS. 2A and 2B. In one example the moisture isolation assembly 206 is interposed between at least a portion of the reveal flange 202 and the fastening base 200. The moisture isolation assembly 206 is configured to prevent the ingress of moisture for instance beyond the reveal flange 202 and along the fastening base 200 to the underlying wall 108 shown in FIG. 1. For instance, in the example shown in FIGS. 2A and 2B the moisture isolation assembly 206 extends along the reveal flange 202 and includes a nozzle ridge 208 and a moisture dam 210 positioned along the reveal flange 202. The nozzle ridge 208 and the moisture dam 210 extend the length of the vertical trim piece 104 and thereby provide for moisture isolation along the length of a siding panel 102 received within the panel reception recess 204.

In one example, the moisture isolation assembly 206 forms an isolation reservoir 212 as shown in FIG. 2B. The isolation reservoir 212 extends along the reveal flange 206 between the nozzle ridge 208 and the moisture dam 210. As will be described herein, in one example the nozzle ridge 208 and the moisture dam 210 provide respective tapers, inclines, declines and the like configured to prevent the ingress of moisture past the nozzle ridge 208 while at the same time retaining any moisture incidentally passing the nozzle ridge 208 within the isolation reservoir 212. Further the moisture dam 210 is inclined, tapered or the like to substantially prevent further ingress of moisture from the isolation reservoir 212 past the moisture dam 210 for instance along the fastening base 200. Optionally the moisture isolation assembly 206 extending along the reveal flange 202 cooperates with the corrugated seal surface 214 (for instance as a composite moisture isolation assembly) to prevent the ingress of moisture along the fastening base 200 and further to prevent the ingress of any incidental moisture to the wall 108 underlying the fastening base 200.

Referring again to FIG. 2B, the moisture isolation assembly 206 is shown with the siding panels 102 received within the panel reception recesses 204. The siding panels 102 engage with each of the nozzle ridge 208 and the moisture dam 210 to close the isolation reservoir 212 between the respective ridge 208 and the dam 210. Accordingly, the engagement between the siding panel 102 and the respective nozzle ridge 208 cooperates with the moisture isolation assembly 206 to prevent the ingress of moisture (the moisture including wind driven rain) past the nozzle ridge 208 and into the isolation reservoir 212. Similarly, the engagement of the siding panel 102 with the moisture dam 210 substantially prevents the ingress of any incidental moisture from the isolation reservoir 212 past the moisture dam 210, for instance toward the fastening base 200.

Figure 3:
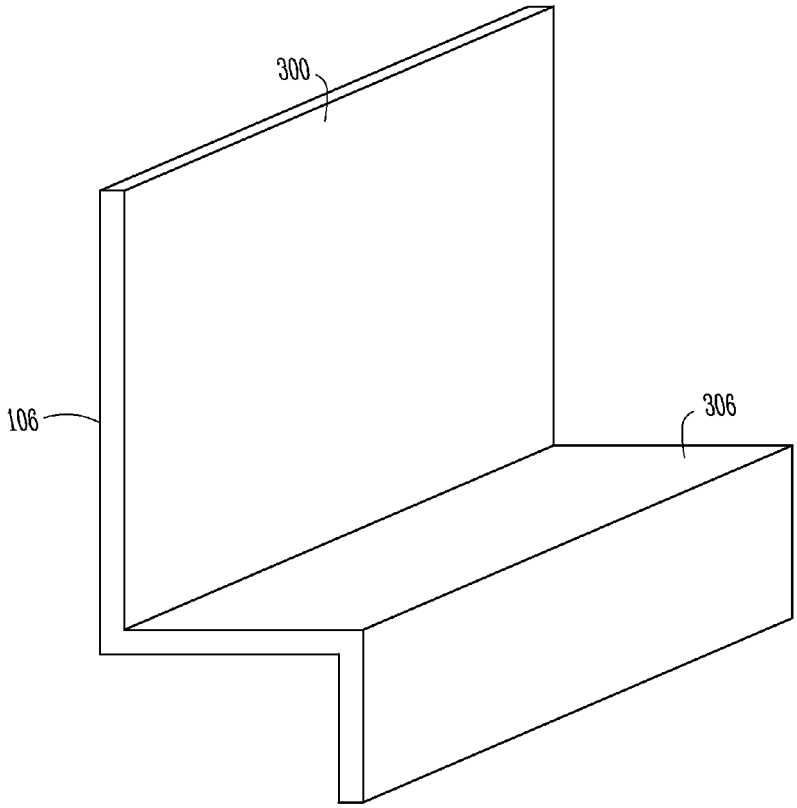
FIG. 3 is a perspective view of one example of a horizontal trim piece.

FIG. 3 shows one example of a horizontal trim piece 106 for instance the trim piece shown in FIG. 1 used in cooperation with the vertical trim pieces 104 to retain a plurality of siding panels 102 along a wall 108. As shown in FIG. 3, the horizontal trim piece 106 includes a fastening base 300 sized and shaped for coupling along the wall 108. In one example the fastening base 300 is punctured for instance with one or more fasteners such as screws, nails or the like (or has preformed holes) to affix the horizontal trim piece 106 to the wall 108. The horizontal trim piece 106 further includes an overlapping flange 306. The overlapping flange 306 extends underneath the bottom portion of an overlying siding panel 102 and extends over top of an underlying siding panel 102. One example of this configuration is shown in FIG. 1. Referring again to FIG. 3, by providing the siding panel underneath the overlapping flange 306 moisture incident along an upper siding panel 102 falls onto the overlapping flange 306 and accordingly washes over the overlapping flange 306 to the vertical surface of the underlying siding panel 102 without reaching the underside of the siding panel 102 or the wall 108. That is to say, the overlapping flange 306 conceals the upper edge of the siding panel 102 and accordingly prevents the ingress of moisture along the upper edge of the siding panel 102 and along the wall 108.

Referring again to FIG. 1 as shown the horizontal trim piece 106 is used in cooperation with one or more vertical trim pieces 104 to provide a system for the reception of the siding panels 102 and diversion of moisture from the wall 108. The vertical trim pieces 104 are coupled with the wall 108 in a vertical fashion while the horizontal trim pieces 106 are interposed between each of the vertical trim pieces 104 and coupled horizontally. Accordingly, corresponding siding panels 102 are received within the panel reception recesses 204 (see FIGS. 2A and 2B) of the vertical trim pieces 104 and the same siding panels 102 overlie portions of the corresponding horizontal trim pieces 106. The vertical and horizontal trim pieces 104, 106 thereby arrange the siding panels 102 as shown in FIG. 1. The siding panels 102 are thereby provided in a decorative arrangement along the wall 108 while at the same time the moisture isolating reveal system 100 (including the vertical and horizontal trim pieces 104, 106) cooperates with the siding panels 102 to divert moisture from reaching the underlying fastening bases such as the fastening bases 200 and 300 of the corresponding vertical and horizontal trim pieces. The ingress of moisture to the wall 108, such as wind driven rain and the like, is thereby prevented (e.g., entirely prevented or mitigated).

Figure 4:
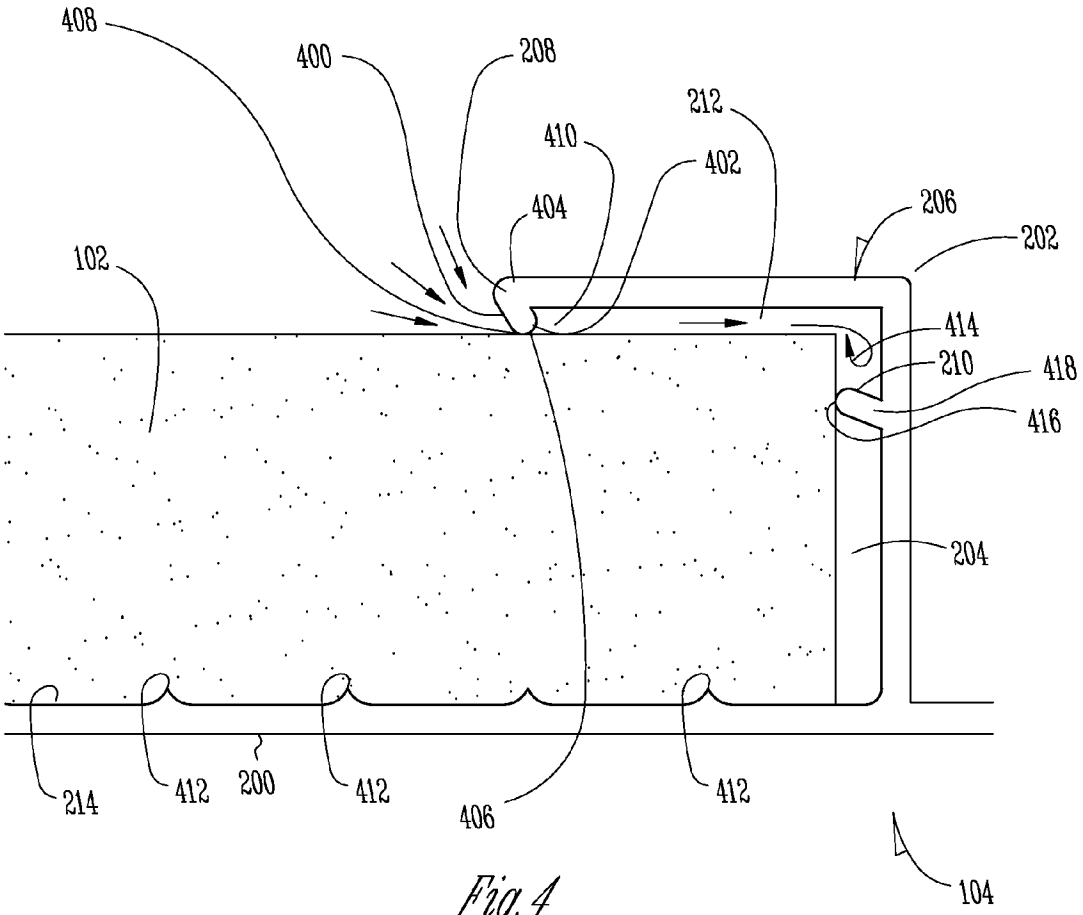
FIG. 4 is detailed cross sectional view of the vertical trim piece shown in FIG. 2B.

FIG. 4 shows a detailed cross sectional view of the vertical trim piece 104 previously shown in FIGS. 2A and 2B. As shown in FIG. 4, the siding panel 102 is received within the panel reception recess 204 and the nozzle ridge 406 and the corrugated seal surface 214 (for instance including a plurality of seal ridges 412) is engaged in a clamping configuration with the siding panel 102. As further shown in FIG. 4, the siding panel 102 is engaged with each of the nozzle ridge 208 and the moisture dam 210 of the moisture isolation assembly 206 previously shown and described in FIGS. 2A and 2B.

As shown in FIG. 4 and further described herein, arrows indicating the flow of moisture under pressure (e.g., wind driven rain) are provided. The moisture is directed toward the nozzle ridge 208 in one example and accordingly moves toward the interface between the nozzle ridge 208 and the siding panel 102. As will be described herein, the moisture isolation assembly 206 substantially prevents (e.g., entirely or substantially retards) the ingress of wind driven moisture behind the reveal flange 202 and across the fastening base 200 for instance to the underlying wall 108 previously shown in FIG. 1.

Referring again to FIG. 4, the nozzle ridge 208 extends from a ridge base 404 to a ridge edge 406. The ridge edge 406 is shown engaged with the siding panel 102, for instance as part of the clamping engagement between the nozzle ridge 208 and the fastening base 200 (e.g., the corrugated seal surface 214). Further, the moisture dam 210 including a dam edge 416 and a dam base 418 is shown engaged with an edge of the siding panel 102. The isolation reservoir 212 extends between the nozzle ridge 208 and the moisture dam 210 as previously described herein. The nozzle ridge 208 and the moisture dam 210 cooperate to prevent the ingress of wind driven moisture into the isolation reservoir 212 while at the same time substantially redirecting any incidental moisture received within the isolation reservoir 212 from the moisture dam 210 back into the isolation reservoir 212 where the moisture is then directed downwardly, for instance along the isolation reservoir 212 to the bottommost portion of the vertical trim piece 104 optionally intersecting with a horizontal trim piece 106.

Referring again to FIG. 4, the nozzle ridge 208 includes an exterior face 400 and an interior face 402 extending from the respective ridge base 404 to the ridge edge 406. As shown in FIG. 4, the exterior face 400 sweeps backwardly toward the moisture dam 210 and thereby includes a tapering configuration that tapers from the ridge base 404 toward the ridge edge 406 (and the siding panel 102). The exterior face 400 thereby provides an acceleration gap 408 between the exterior face 400 and the siding panel 102. In a contrasting manner, the interior face 402 of the nozzle ridge 208, for instance from the ridge edge 406 to the ridge base 404, cooperates with the reveal flange 202 and the siding panel 102 to provide a reservoir gap 410 having a greater width relative to the acceleration gap 408, for instance that portion of the acceleration gap 408 immediately adjacent to the engagement of the ridge edge 406 with the siding panel 102.

In operation pressurized moisture (e.g., wind driven rain, pressurized fluids or the like) incident along the siding panel 102 is driven toward the acceleration gap 408. The acceleration gap 408 cooperates with the siding panel 102 to accelerate the wind driven moisture toward the interface of the ridge edge 406 to the siding panel 102 according to the tapering configuration of the acceleration gap 408. Any incidental moisture that is accelerated into the acceleration gap 408 and is able to bypass the interface at the ridge edge 406 with the siding panel 102 is thereafter received within the isolation reservoir 212. The reservoir gap 410 opens up from the interface between the ridge edge 406 and the siding panel 102 and is wider than the adjacent portion of the acceleration gap 408. Accordingly, high velocity moisture passing by the ridge edge 406 immediately decelerates because of the expanding area (width) of the reservoir gap 410. Any slowed moisture within the reservoir gap 410 (the isolation reservoir 212) slows down and provides a dam for additional moisture moving through the acceleration gap 408. That is to say, moisture accumulating behind the nozzle ridge 208, for instance within the reservoir gap 410 slows any additional moisture moving through the interface at the ridge edge 406 and the siding panel 102 and accordingly further prevents the ingress of additional moisture into the isolation reservoir 212. Incidental moisture within the reservoir gap 410 forms a hydrodynamic dam that prevents (stops or substantially retards) the ingress of additional moisture.

In another example, the moisture dam 210, in contrast to the nozzle ridge 208, sweeps in a forward direction for instance toward the nozzle ridge 208. That is to say, the moisture dam 210 tapers toward the siding panel 102 and the nozzle ridge 208 in the configuration shown in FIG. 4. The moisture dam 210 sweeps forward from the dam base 418 to the dam edge 416 and accordingly forms a dam gap 414 between the siding panel 102 and the reveal flange 202.

In operation, any incidental moisture driven into the isolation reservoir 212 past the nozzle ridge 208 and toward to the moisture dam 210 is redirected by the moisture dam 210. The forward sweeping configuration of the moisture dam 210, for instance at the dam gap 414, redirects moisture incident along the moisture dam 210 back into the isolation reservoir 212. Accordingly, any pressurized moisture delivered into the isolation reservoir 212 is substantially prevented from moving past the interface of the dam edge 416 with the siding panel 102. Instead, the moisture is redirected by the forward sweeping moisture dam 210 into the isolation reservoir 212. Any moisture incidentally able to move into the vertical trim piece is captured by the moisture isolation assembly 206 and retained within the isolation reservoir 212 and constrained from further ingress toward the fastening base 200 and the wall 108 (see FIG. 1).

Furthermore, any incidental moisture that does reach the fastening base 200 is correspondingly prevented from extending along or behind the fastening base 200 by the clamping engagement of the corrugated seal surface 214 (e.g., including a plurality of seal ridges 412 having a saw tooth configuration or scalloped configuration) with the siding panel 102 as shown in FIG. 4. Ingress of moisture along the fastening base 200 and to the wall 108 (see FIG. 1) is thereby substantially prevented.

Figure 5A:
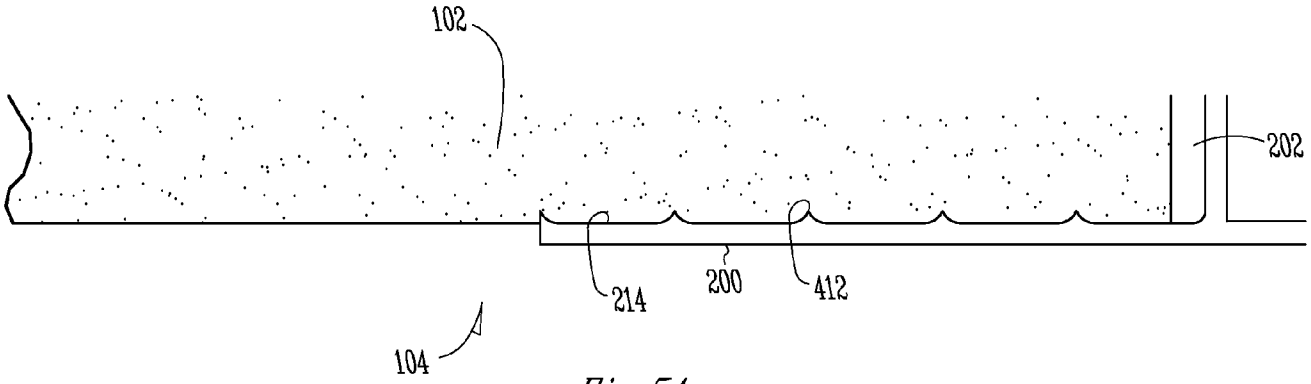
FIG. 5A is a detailed cross sectional view of a fastener base coupled along a siding panel.
Figure 5B:
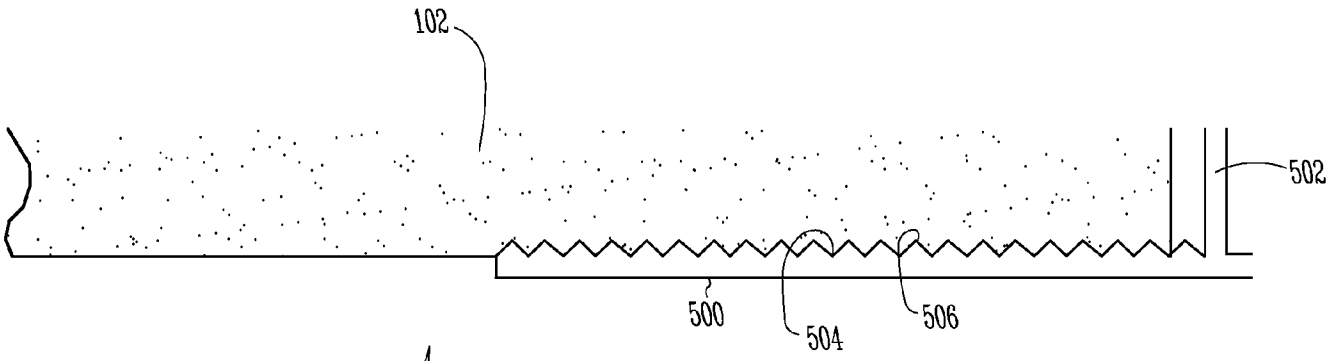
FIG. 5B is a detailed cross sectional view of another example of a fastener base coupled along a siding panel.

FIGS. 5A and 5B show differing examples of the fastening base for instance the fastening base of the vertical trim piece 104 previously described herein. In one example the fastening base 200 shown in FIG. 5A corresponds to the fastening base previously shown in FIGS. 2A and 2B. For instance, the fastening base 200 includes a corrugated seal surface 214 having a plurality of seal ridges 412 formed in a scalloped configuration along the interior surface of the fastening base 200. As described herein, the seal ridges 412 cooperate with the siding panel and the opposed nozzle ridge 208 (see FIGS. 2A and 2B) to clamp the siding panel 102 within the panel reception recess 204 and thereby tightly engage the ridges along the back side of the siding panel 102. Accordingly, the ingress of moisture, for instance moisture able to incidentally move past the moisture isolation assembly 206, is substantially prevented from further ingress past or over the fastening base 200 (e.g., to the wall 108 underlying the siding panels 102 and the vertical trim piece 104).

FIG. 5B shows another example of a fastening base 500 of a vertical trim piece, such as the vertical trim piece 104 previously shown in FIGS. 2A and 2B. The vertical trim piece 104 shown in FIG. 5B includes a fastening base 500 and a reveal flange 502 in a similar configuration to the vertical trim piece 104 previously shown in FIGS. 2A and 2B. In the example shown in FIG. 5B, the fastening base 500 includes a corrugated seal surface 504 sized and shaped to engage along a surface of the siding panel 102. The corrugated seal surface 504 in the example shown includes a plurality of seal ridges 506, for instance having a saw tooth configuration, sized and shaped to engage along the siding panel 102 and thereby clamp the siding panel 102 in cooperation with the nozzle ridge 208 shown in FIGS. 2A and 2B. In a similar manner to the fastener base 200 shown in FIG. 5A, the fastening base 500 including the corrugated seal surface 504 engages against the siding panel 102 in a clamping configuration along with the nozzle ridge 208. The seal ridges 506 of the corrugated seal surface 504 engage with the siding panel and thereby substantially prevent the further ingress of moisture along the fastening base 500 for instance to the underlying siding panel 102 (shown in FIG. 1).

With the configurations shown in FIGS. 5A, 5B for the fastening bases 200, 500 the corrugated seal surfaces 214 and 504 are configured to engage with the siding panel 102, seal along the siding panel 102, and substantially prevent the ingress of moisture across the fastening bases 200, 500.

Stated another way, the moisture isolation assembly 206 as shown in FIGS. 2A and 2B is configured to prevent the ingress of moisture and also retain and divert moisture incidentally passing beyond the nozzle ridge 208 within an isolation reservoir (the reservoir 212 as shown for instance in FIGS. 2A, 2B and 4) and thereby prevent the transmission of moisture to the fastening base 200, 500. The fastening bases 200, 500 with their corrugated seal surfaces 214, 504 provide a second line of moisture ingress prevention that substantially prevents further ingress of moisture for instance across the fastening bases 200, 500 to the underlying siding panel 102.

Figure 6A:
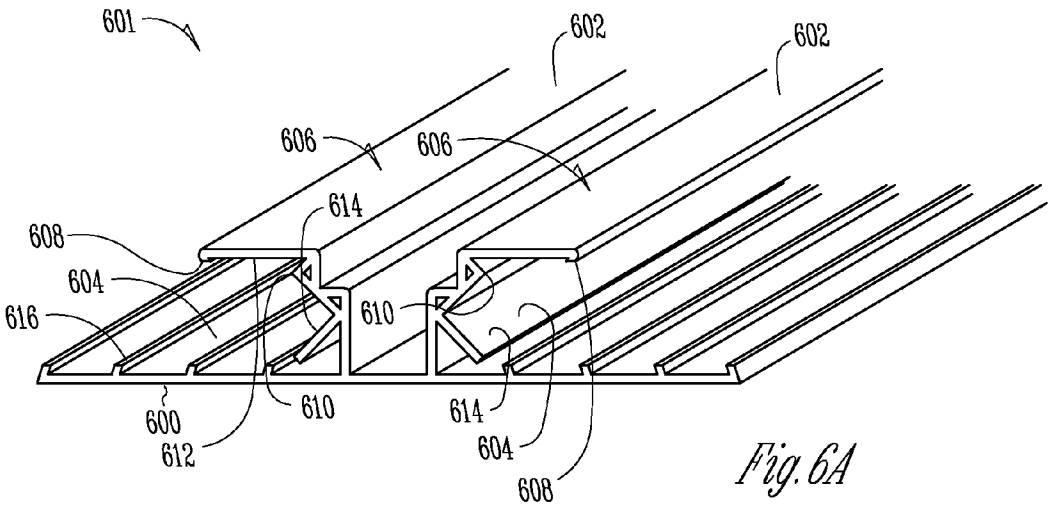
FIG. 6A is a perspective view of another example of a vertical trim piece including a sealant tray and one or more panel stops.
Figure 6B:
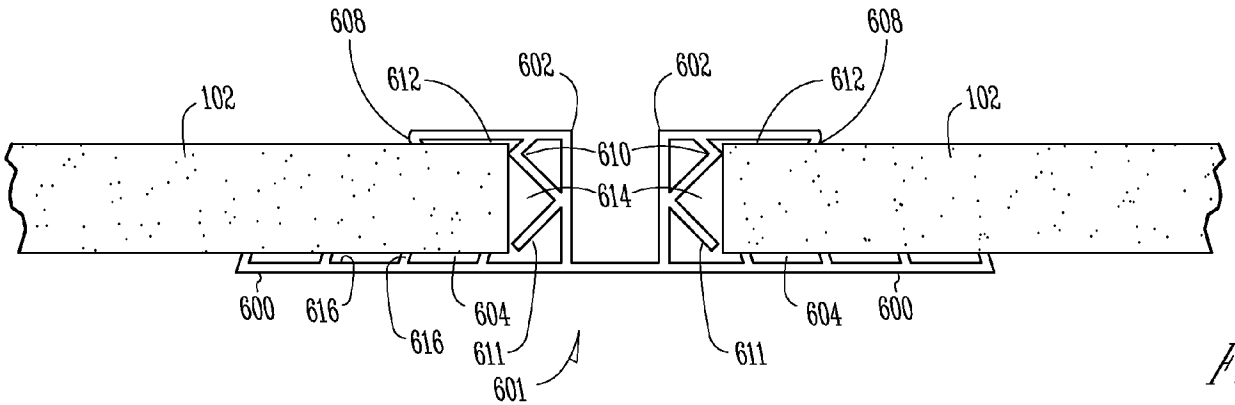
FIG. 6B is a cross sectional view of the vertical trim piece of FIG. 6A.

FIGS. 6A and 6B show another example of a vertical trim piece 601. As shown, the vertical trim piece 601 includes a series of features similar in at least some regards to the previously described vertical trim piece 104 shown in FIGS. 2A and 2B. For instance, the vertical trim piece 601 includes a fastening base 600 having a corrugated seal surface 616 and a reveal flange 602 extending from the fastening base 600. In one example the reveal flange 602 is bifurcated into opposed reveal flanges 602 extending from the fastening base 600 and then bending or turning in a substantially parallel direction to the fastening base 600 to form respective panel reception recesses 604 for reception of the siding panels 102 therein. As previously described, in another example the reveal flange 602 is a unitary assembly extending from the fastening base 600 and the reveal flange 602 splits into the respective separate extending portions to thereby provide the opposed panel reception recesses 604.

The vertical trim piece 601 further includes a moisture isolation assembly 606 including a nozzle ridge 608 and a moisture dam 610 to form an isolation reservoir 612 therebetween. The moisture isolation assembly 606 operates in a similar manner to the moisture isolation assembly 206 previously described herein. Additionally, the corrugated seal surface 616 cooperates with the moisture isolation assembly 606 (and as in one example part of a composite moisture isolation assembly) to substantially prevent the passage of moisture, for instance water from the reveal flange 602, across the fastening base 600. That is to say, the moisture isolation assembly 606 substantially prevents the ingress of moisture from the siding panel 102 into the reveal flange 602 by providing the nozzle ridge 608 (including for instance the acceleration gap 408 in the reservoir gap 410 as described herein) and cooperates with the moisture dam 610 to retain any incidentally entering moisture within the isolation reservoir 612. Additionally, the moisture isolation assembly 606 cooperates with the corrugated seal surface 616 (e.g., a plurality of ridges) engaged along the siding panel 102 to substantially prevent passage (preventing or substantially retarding) of moisture beyond the moisture isolation assembly 606 for instance across the fastening base 600.

In another example, the moisture dam 610 projects from the reveal flange 602 to provide a panel stop for the siding panels 102. For instance, as shown in FIG. 6B the moisture dam 610 as well as the opposed side 611 of the moisture dam (adjacent to the fastening base 600) provides an affirmative stop for a siding panel 102 positioned within the panel reception recess 604. The moisture dam 610 cooperates with the siding panel 102 to substantially prevent the full seating of the siding panel 102 along the reveal flange 602. Accordingly, a channel is retained alongside the siding panel 102. In one example the channel is a sealant tray 614 provided adjacent to the edge of the siding panel 102. The space provided by the sealant tray 614 allows for the downward passage of any moisture incidentally passing through the moisture isolation assembly 606 prior to the moisture reaching the fastening base 600.

In another example the sealant tray 614 is sized and shaped to receive a bead of sealant therein for instance a gasket, silicone caulk sealant, another sealant, or the like. As the siding panel 102 is received within the panel reception recess 604 the sealant within the sealant tray 614 provides an affirmative seal between the sealant tray 614 and the siding panel 102. Because insertion of the siding panel 102 is arrested by the moisture dam 610 (as well as the opposed projection 611 at the other side of the sealant tray 614) any sealant provided within the sealant tray 614 is retained therein and facilitates the continued operation of the moisture isolation assembly 606 in a desired manner. For instance, the moisture dam 610 with its forward sweeping configuration is able to continue to direct moisture back towards the nozzle ridge 608. The forward sweeping portion of the moisture dam 610 within the isolation reservoir 612 is not fouled by sealant pushed from the sealant tray 614 into the isolation reservoir 612.

In one example the trim pieces for instance the vertical and horizontal trim pieces 104, 106 as well as the vertical trim piece 601 are constructed with one or more methods including but not limited to extrusion or pultrusion of a polymer or metal through an extrusion or pultrusion die. The lineal pieces delivered from a die are cut to a desired length. In another example, the vertical and horizontal trim pieces 104, 106 as well as the vertical trim piece 601 shown in FIG. 6A are formed with a molding process and optionally cut to a desired length. In the extrusion or pultrusion example the pultruded or extruded vertical trim piece 601, 104 or the horizontal trim piece 106 is cut to linear lengths as needed either onsite or at the factory. In another example, the trim pieces such as the vertical and horizontal trim pieces 104, 106 shown in FIG. 1 and the vertical trim piece 601 shown in FIGS. 6A, B are constructed with but not limited to polymers or metals or a composite of both. For instance, the trim pieces are constructed with, but are not limited to, PVC, aluminum or the like.

Figure 7:
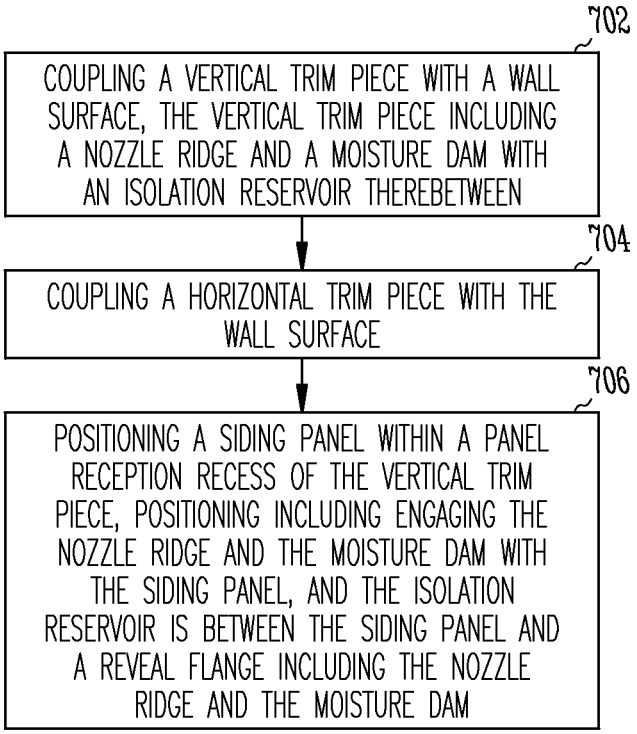
FIG. 7 is block diagram showing one method for installing a moisture isolation reveal system.

FIG. 7 shows one example of a block diagram illustrating an example of a method 700 for installing a moisture isolating reveal system, such as the moisture isolating reveal system 100 shown in FIGS. 1, 2A and 2B. In describing the method 700 reference is made to features previously described herein including numbered references. References to these features is done for convenience and is not intended to be limiting. Instead, numbered references are provided for convenience and further include any similar features and their equivalents. At 702, the method 700 includes coupling a vertical trim piece 104, 600 with the wall surface, such as the wall 108 shown in FIG. 1. The vertical trim piece 104, 601 includes a nozzle ridge 208, 608 and a moisture dam 210, 610 with an isolation reservoir 212, 612 therebetween. As previously described, the moisture isolation assembly 206 (including for instance the nozzle ridge 208 and the moisture dam 210) cooperates with a siding panel 102 provided within a panel reception recess 204 to substantially prevent the ingress of moisture beyond the moisture isolation assembly 206, for instance to a position behind the reveal flange 202 (see FIGS. 2A, B).

At 704, a horizontal trim piece 106 is coupled with the wall surface 108. For instance, as shown in FIG. 1 the horizontal trim piece 106 is coupled with the wall 108 in a substantially horizontal configuration relative to the vertical positioning of the vertical trim piece 104. The horizontal trim piece cooperates with the vertical trim piece 104 to substantially divert moisture (e.g., wind driven rain, pressurized fluids or the like) incident against the siding panels 102 in a downward fashion without allowing the moisture to reach the wall 108 underlying the vertical and horizontal trim pieces 104, 106 and the siding panels 102.

At 706, the method 700 further includes positioning a siding panel, such as the siding panels 102 shown in FIG. 1, within a panel reception recess 204 of the vertical trim pieces 104. Positioning of the siding panel 102 includes engaging the nozzle ridge 208 and the moisture dam 210 with the siding panel 102. The isolation reservoir, for instance shown as element 212 in FIGS. 2A, B and element 612 in FIG. 6, is between the siding panel 102 and the reveal flange 202. The reveal flange optionally includes in one example the nozzle ridge 208 and the moisture dam 210 as described herein.

Several options for the method 700 follow. In one example, engaging the nozzle ridge with the siding panel 102 forms an acceleration gap 408 between the siding panel 102 and an exterior face 400 of the nozzle ridge 208. The acceleration gap 408 tapers toward a ridge edge 406, and the exterior face 400 accelerates moisture, such as wind driven rain, moving toward the ridge edge 406 according to the taper. In another example, engaging the nozzle ridge 208 with the siding panel 102 forms a reservoir gap, such as the reservoir gap 410 shown in FIG. 4 between the siding panel 102 and an interior face 402 of the nozzle ridge 208. The reservoir gap 410 is wider than the acceleration gap 408 at the ridge edge 406 and the reservoir gap 410 decelerates moisture moving past the ridge edge 406 into the isolation reservoir 212 according to the relatively wider reservoir gap 410. For instance, as described herein the wider reservoir gap 410 decreases the velocity of any incidental moisture moving into the isolation reservoir 212 and accordingly provides a dam or throttling effect (e.g., a hydrodynamic dam) to any later passing moisture driven at high velocities through the acceleration gap 408.

In another example, engaging the moisture dam 210 with the siding panel 102 includes forming a dam gap 414 between the moisture dam 210 and the reveal flange 202. The dam gap 414 tapers toward a dam base 418 from the dam edge 416. Moisture moving through the isolation reservoir 212 toward the moisture dam 210 is redirected toward the isolation reservoir 212 according to the taper.

In still another example, the method 700 includes clamping the siding panel 102 between the nozzle ridge 208 and the fastening base 200 of the vertical trim piece 104. For instance, clamping of the siding panel 102 is included with positioning of the siding panel within the panel reception recess 204 as shown for instance in FIG. 4. That is to say, the nozzle ridge 208 cooperates with the corrugated seal surface 214 of the fastening base 200 to clamp the siding panel 102 therein. As described herein clamping of the siding panel 102 includes sealing a plurality of seal ridges 412 (or 506) along the siding panel 102. The ingress of moisture, for instance any incidental moisture moving past the moisture isolation assembly 206, is interrupted according to the sealing of the plurality of seal ridges 412 (or 506) to the siding panel 102.

VARIOUS NOTES & EXAMPLES

Example 1 can include subject matter such as a moisture isolating reveal system, such as can include a siding panel; and a vertical trim piece including: a fastening base configured for vertical coupling along a wall, a reveal flange extending from the fastening base, the fastening base and the reveal flange forming a panel reception recess, the siding panel within the panel reception recess, and a moisture isolation assembly along one or more of the reveal flange or the fastening base, the moisture isolation assembly includes: a nozzle ridge provided along the reveal flange, a moisture dam interposed between the nozzle ridge and the fastening base, the moisture dam prevents the ingress of moisture to the fastening base, each of the nozzle ridge and the moisture dam are engaged with the siding panel, and the nozzle ridge accelerates moisture moving between the nozzle ridge and the siding panel and decelerates moisture between the nozzle ridge and the moisture dam.

Example 2 can include, or can optionally be combined with the subject matter of Example 1, to optionally include wherein the nozzle ridge tapers toward the siding panel and the moisture dam.

Example 3 can include, or can optionally be combined with the subject matter of one or any combination of Examples 1 or 2 to optionally include wherein the moisture dam tapers toward the siding panel and the nozzle ridge.

Example 4 can include, or can optionally be combined with the subject matter of one or any combination of Examples 1 through 3 to optionally include wherein the nozzle ridge extends toward the moisture dam and the moisture dam extends toward the nozzle ridge.

Example 5 can include, or can optionally be combined with the subject matter of one or any combination of Examples 1-4 optionally to include wherein the nozzle ridge includes an exterior face and an interior face, both of the exterior and interior faces extend to a ridge edge engaged with the siding panel.

Example 6 can include, or can optionally be combined with the subject matter of Examples 1-5 to optionally include wherein the exterior face and the siding panel form an acceleration gap that tapers toward the ridge edge, moisture moving between the nozzle ridge and the siding panel accelerates according to the taper, and the interior face and the siding panel form a reservoir gap wider than the acceleration gap at the ridge edge, and moisture moving from the acceleration gap to the reservoir gap is decelerated according to the wider reservoir gap.

Example 7 can include, or can optionally be combined with the subject matter of Examples 1-6 to optionally include wherein the nozzle ridge, the moisture dam, the reveal flange and a portion of the siding panel form an isolation reservoir spaced from the fastening base, the isolation reservoir within the panel reception recess.

Example 8 can include, or can optionally be combined with the subject matter of Examples 1-7 to optionally include wherein the fastening base includes a corrugated seal surface as part of the moisture isolation assembly, and the corrugated seal surface includes a plurality of seal ridges facing the siding panel, the seal ridges are sealed along the siding panel and are configured to prevent the ingress of moisture along the fastening base.

Example 9 can include, or can optionally be combined with the subject matter of Examples 1-8 to optionally include wherein the siding panel is clamped between the nozzle ridge and the corrugated seal surface.

Example 10 can include, or can optionally be combined with the subject matter of Examples 1-9 to optionally include a moisture isolating reveal system comprising: a vertical trim piece including: a fastening base configured for vertical coupling along a wall; a reveal flange extending from the fastening base, the fastening base and the reveal flange forming a panel reception recess; and a moisture isolation assembly along one or more of the reveal flange and the fastening base, the moisture isolation assembly includes: a nozzle ridge provided along the reveal flange, a moisture dam interposed between the nozzle ridge and the fastening base, the nozzle ridge and the moisture dam form an isolation reservoir along the reveal flange.

Example 11 can include, or can optionally be combined with the subject matter of Examples 1-10 to optionally include wherein the isolation reservoir is spaced from the fastening base.

Example 12 can include, or can optionally be combined with the subject matter of Examples 1-11 to optionally include wherein the nozzle ridge includes an exterior face and an interior face, both of the exterior and interior faces extend to a ridge edge configured for engagement with a siding panel.

Example 13 can include, or can optionally be combined with the subject matter of Examples 1-12 to optionally include wherein the exterior face is configured to accelerate moisture moving toward the ridge edge according to a taper of the exterior face, and the interior face is configured to decelerate moisture moving past the ridge edge into the isolation reservoir.

Example 14 can include, or can optionally be combined with the subject matter of Examples 1-13 to optionally include wherein the exterior face forms an acceleration gap that tapers toward the ridge edge when engaged with the siding panel, and the interior face forms a reservoir gap within the isolation reservoir when engaged with the siding panel, the reservoir gap is wider than the acceleration gap at the ridge edge.

Example 15 can include, or can optionally be combined with the subject matter of Examples 1-14 to optionally include wherein the nozzle ridge sweeps backward along the reveal flange toward the isolation reservoir from a ridge base at the reveal flange to the ridge edge.

Example 16 can include, or can optionally be combined with the subject matter of Examples 1-15 to optionally include wherein the moisture dam sweeps forward along the reveal flange toward the isolation reservoir from a dam base at the reveal flange to a dam edge.

Example 17 can include, or can optionally be combined with the subject matter of Examples 1-16 to optionally include wherein the moisture dam is configured to redirect moisture moving through the isolation reservoir toward the moisture dam in an opposed direction away from the moisture dam according to the forward sweep of the moisture dam from the dam base to the dam edge.

Example 18 can include, or can optionally be combined with the subject matter of Examples 1-17 to optionally include wherein the moisture dam forms a dam gap between the moisture dam and the reveal flange, and the dam gap tapers toward the dam base from the dam edge.

Example 19 can include, or can optionally be combined with the subject matter of Examples 1-18 to optionally include a horizontal trim piece coupled with the vertical trim piece.

Example 20 can include, or can optionally be combined with the subject matter of Examples 1-19 to optionally include one or more siding panels coupled with the horizontal trim piece and received within the panel reception recess.

Example 21 can include, or can optionally be combined with the subject matter of Examples 1-20 to optionally include a method for installing a moisture isolating reveal system comprising: coupling a vertical trim piece with a wall surface, the vertical trim piece including a nozzle ridge and a moisture dam with an isolation reservoir therebetween; coupling a horizontal trim piece with the wall surface; and positioning a siding panel within a panel reception recess of the vertical trim piece, positioning including engaging the nozzle ridge and the moisture dam with the siding panel, and the isolation reservoir is between the siding panel and a reveal flange including the nozzle ridge and the moisture dam.

Example 22 can include, or can optionally be combined with the subject matter of Examples 1-21 to optionally include wherein engaging the nozzle ridge with the siding panel forms an acceleration gap between the siding panel and an exterior face of the nozzle ridge, the acceleration gap tapers toward a ridge edge, and the exterior face accelerates moisture moving toward the ridge edge according to the taper.

Example 23 can include, or can optionally be combined with the subject matter of Examples 1-22 to optionally include wherein engaging the nozzle ridge with the siding panel forms a reservoir gap between the siding panel and an interior face of the nozzle ridge, the reservoir gap is wider than the acceleration gap at the ridge edge, and the reservoir gap decelerates moisture moving past the ridge edge into the isolation reservoir according to the wider reservoir gap.

Example 24 can include, or can optionally be combined with the subject matter of Examples 1-23 to optionally include wherein engaging the moisture dam with the siding panel includes forming a dam gap between the moisture dam and the reveal flange, the dam gap tapers toward a dam base from the dam edge, and moisture moving through the isolation reservoir toward the moisture dam is redirected toward into the isolation reservoir according to the taper.

Example 25 can include, or can optionally be combined with the subject matter of Examples 1-24 to optionally include wherein positioning the siding panel within the panel reception recess includes clamping the siding panel between the nozzle ridge and a fastening base of the vertical trim piece.

Example 26 can include, or can optionally be combined with the subject matter of Examples 1-25 to optionally include wherein clamping the siding panel includes sealing a plurality of seal ridges of the fastening base along the siding panel, and the ingress of moisture between the fastening base and the siding panel is interrupted according to the sealing of the plurality of seal ridges.

Each of these non-limiting examples can stand on its own, or can be combined in any permutation or combination with any one or more of the other examples.

The above detailed description includes references to the accompanying drawings, which form a part of the detailed description. The drawings show, by way of illustration, specific embodiments in which the invention can be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

In the event of inconsistent usages between this document and any documents so incorporated by reference, the usage in this document controls.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, composition, formulation, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to comply with 37 C.F.R. §1.72(b), to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description as examples or embodiments, with each claim standing on its own as a separate embodiment, and it is contemplated that such embodiments can be combined with each other in various combinations or permutations. The scope of the invention should be determined with reference to the appended claims, along with the full scope of equivalents to which such claims are entitled.

The claimed invention is:

1. A moisture isolating reveal system comprising:
- a siding panel; and
- a vertical trim piece including:
  - a fastening base configured for vertical coupling along a wall,
  - a reveal flange extending from the fastening base, the fastening base and the reveal flange forming a panel reception recess, the siding panel within the panel reception recess, and
  - a moisture isolation assembly along one or more of the reveal flange or the fastening base, the moisture isolation assembly includes:
    - a nozzle ridge provided along the reveal flange,
    - a moisture dam interposed between the nozzle ridge and the fastening base, the moisture dam prevents the ingress of moisture to the fastening base, each of the nozzle ridge and the moisture dam are engaged with the siding panel, wherein the nozzle ridge, the moisture dam, the reveal flange and a portion of the siding panel form an isolation reservoir spaced from the fastening base, the isolation reservoir within the panel reception recess, and
    - the nozzle ridge accelerates moisture moving between the nozzle ridge and the siding panel and decelerates moisture between the nozzle ridge and the moisture dam.

2. The moisture isolating reveal system of claim 1, wherein the nozzle ridge tapers toward the siding panel and the moisture dam.

3. The moisture isolating reveal system of claim 1, wherein the moisture dam tapers toward the siding panel and the nozzle ridge.

4. The moisture isolating reveal system of claim 1, wherein the nozzle ridge extends toward the moisture dam and the moisture dam extends toward the nozzle ridge.

5. The moisture isolating reveal system of claim 1, wherein the nozzle ridge includes an exterior face and an interior face, both of the exterior and interior faces extend to a ridge edge engaged with the siding panel.

6. The moisture isolating reveal system of claim 5, wherein the exterior face and the siding panel form an acceleration gap that tapers toward the ridge edge, moisture moving between the nozzle ridge and the siding panel accelerates according to the taper, and
- the interior face and the siding panel form a reservoir gap wider than the acceleration gap at the ridge edge, and moisture moving from the acceleration gap to the reservoir gap is decelerated according to the wider reservoir gap.

7. The moisture isolating reveal system of claim 1, wherein the fastening base includes a corrugated seal surface as part of the moisture isolation assembly, and the corrugated seal surface includes a plurality of seal ridges facing the siding panel, the seal ridges are sealed along the siding panel and are configured to prevent the ingress of moisture along the fastening base.

8. The moisture isolating reveal system of claim 7, wherein the siding panel is clamped between the nozzle ridge and the corrugated seal surface.

9. A moisture isolating reveal system for use with a siding panel, the system comprising:
- a vertical trim piece including:
  - a fastening base configured for vertical coupling along a wall;
  - a reveal flange extending from the fastening base, the fastening base and the reveal flange forming a panel reception recess; and
  - a moisture isolation assembly along one or more of the reveal flange and the fastening base, the moisture isolation assembly includes:
    - a nozzle ridge provided along the reveal flange,
    - a moisture dam interposed between the nozzle ridge and the fastening base, the nozzle ridge, the moisture dam, the revel flange and a portion of the siding panel form an isolation reservoir, the isolation reservoir within the panel reception recess.

10. The moisture isolating reveal system of claim 9, wherein the isolation reservoir is spaced from the fastening base.

11. The moisture isolating reveal system of claim 9, wherein the nozzle ridge includes an exterior face and an interior face, both of the exterior and interior faces extend to a ridge edge configured for engagement with a siding panel.

12. The moisture isolating reveal system of claim 11, wherein the exterior face is configured to accelerate moisture moving toward the ridge edge according to a taper of the exterior face, and the interior face is configured to decelerate moisture moving past the ridge edge into the isolation reservoir.

13. The moisture isolating reveal system of claim 11, wherein the exterior face forms an acceleration gap that tapers toward the ridge edge when engaged with the siding panel, and the interior face forms a reservoir gap within the isolation reservoir when engaged with the siding panel, the reservoir gap is wider than the acceleration gap at the ridge edge.

14. The moisture isolating reveal system of claim 11, wherein the nozzle ridge sweeps backward along the reveal flange toward the isolation reservoir from a ridge base at the reveal flange to the ridge edge.

15. The moisture isolating reveal system of claim 9, wherein the moisture dam sweeps forward along the reveal flange toward the isolation reservoir from a dam base at the reveal flange to a dam edge.

16. The moisture isolating reveal system of claim 15, wherein the moisture dam is configured to redirect moisture moving through the isolation reservoir toward the moisture dam in an opposed direction away from the moisture dam according to the forward sweep of the moisture dam from the dam base to the dam edge.

17. The moisture isolating reveal system of claim 15, wherein the moisture dam forms a dam gap between the moisture dam and the reveal flange, and the dam gap tapers toward the dam base from the dam edge.

18. The moisture isolating reveal system of claim 9 comprising a horizontal trim piece coupled with the vertical trim piece.

19. The moisture isolating reveal system of claim 18 comprising one or more siding panels coupled with the horizontal trim piece and received within the panel reception recess.

20. A method for installing a moisture isolating reveal system comprising:

coupling a vertical trim piece with a wall surface, the vertical trim piece including a nozzle ridge and a moisture dam with an isolation reservoir therebetween;

coupling a horizontal trim piece with the wall surface; and positioning a siding panel within a panel reception recess of the vertical trim piece, said positioning step further including engaging the nozzle ridge and the moisture dam with the siding panel, and the isolation reservoir is between the siding panel and a reveal flange including the nozzle ridge and the moisture dam.

21. The method of claim 20, wherein engaging the nozzle ridge with the siding panel forms an acceleration gap between the siding panel and an exterior face of the nozzle ridge, the acceleration gap tapers toward a ridge edge, and the exterior face accelerates moisture moving toward the ridge edge according to the taper.

22. The method of claim 21, wherein engaging the nozzle ridge with the siding panel forms a reservoir gap between the siding panel and an interior face of the nozzle ridge, the reservoir gap is wider than the acceleration gap at the ridge edge, and the reservoir gap decelerates moisture moving past the ridge edge into the isolation reservoir according to the wider reservoir gap.

23. The method of claim 20, wherein engaging the moisture dam with the siding panel includes forming a dam gap between the moisture dam and the reveal flange, the dam gap tapers toward a dam base from the dam edge, and moisture moving through the isolation reservoir toward the moisture dam is redirected toward into the isolation reservoir according to the taper.

24. The method of claim 20, wherein positioning the siding panel within the panel reception recess includes clamping the siding panel between the nozzle ridge and a fastening base of the vertical trim piece.

25. The method of claim 24, wherein clamping the siding panel includes sealing a plurality of seal ridges of the fastening base along the siding panel, and the ingress of moisture between the fastening base and the siding panel is interrupted according to the sealing of the plurality of seal ridges.

* * * * *